US008716201B2

(12) United States Patent
Carey et al.

(10) Patent No.: US 8,716,201 B2
(45) Date of Patent: May 6, 2014

(54) ALKYLATED NAPHTYLENE BASE STOCK LUBRICANT FORMULATIONS

(75) Inventors: James T. Carey, Medford, NJ (US); Angela S. Galiano-Roth, Mullica Hill, NJ (US); Gary K. Dudley, Lambertville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 85 days.

(21) Appl. No.: 12/893,434

(22) Filed: Sep. 29, 2010

(65) Prior Publication Data

US 2011/0082061 A1 Apr. 7, 2011

Related U.S. Application Data

(60) Provisional application No. 61/278,228, filed on Oct. 2, 2009.

(51) Int. Cl.
*C10M 169/04* (2006.01)

(52) U.S. Cl.
USPC ..... 508/110; 508/591

(58) Field of Classification Search
USPC ..... 508/110, 591
See application file for complete search history.

(56) References Cited

U.S. PATENT DOCUMENTS 2,978,442 A 4/1961 Brightbill et al.
3,149,178 A 9/1964 Hamilton et al.
3,164,578 A 1/1965 Baker et al.
3,382,291 A 5/1968 Brennan
3,576,923 A 4/1971 Randell et al.
3,742,082 A 6/1973 Brennan
3,769,363 A 10/1973 Brennan (Continued)

FOREIGN PATENT DOCUMENTS

EP 0119069 A2 9/1984
EP 01197962 A1 9/1984

(Continued)

OTHER PUBLICATIONS

J. Brennan, "Wide-Temperature Range Synthetic Hydrocarbon Fluids", Ind. Eng. Chem. Prod. Res. Dev., 1980, vol. 19, pp. 2-6.

(Continued)

*Primary Examiner* — Taiwo Oladapo
(74) *Attorney, Agent, or Firm* — Robert A. Migliorini

(57) ABSTRACT

In one embodiment a novel lubricant is disclosed. The lubricant comprises an alkylated naphthalene base stock with a viscosity of at least 2 cSt and less than 22 cSt kv100° C., the alkylated naphthalene base stock is greater than 55 weight percent of the lubricant, a PAO base stock with at least 4 cSt and less than 250 cSt kv100° C., the PAO base stock is at least 2 and less than 40 weight percent of the lubricant, at least 0.5 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv100° C., less than 10 ppm metals, less than 100 ppm sulfur, and a VI greater than 70.

8 Claims, 4 Drawing Sheets

(56) References Cited

U.S. PATENT DOCUMENTS 3,780,128 A 12/1973 Shubkin
3,876,720 A 4/1975 Heilman et al.
3,883,417 A 5/1975 Woo et al.
4,016,349 A 4/1977 McKenna
4,132,663 A 1/1979 Heilman et al.
4,172,855 A 10/1979 Shubkin et al.
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,308 A 2/1984 Larkin et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,737,297 A 4/1988 Yoshida et al.
4,776,967 A 10/1988 Ichihashi et al.
4,827,064 A 5/1989 Wu
4,827,073 A 5/1989 Wu
4,892,851 A 1/1990 Ewen et al.
4,906,799 A 3/1990 Forbus, Jr. et al.
4,910,355 A 3/1990 Shubkin et al.
4,912,272 A 3/1990 Wu
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,956,122 A 9/1990 Watts et al.
4,962,249 A 10/1990 Chen et al.
4,962,262 A 10/1990 Winter et al.
4,967,032 A 10/1990 Ho et al.
4,990,709 A 2/1991 Wu
4,990,711 A 2/1991 Chen et al.
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,087,788 A 2/1992 Wu
5,104,579 A 4/1992 Benjamin et al.
5,105,038 A 4/1992 Chen et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,180,865 A 1/1993 Heilman et al.
5,186,851 A 2/1993 Gutierrez et al.
5,187,250 A 2/1993 Asanuma et al.
5,188,724 A 2/1993 Heilman et al.
5,190,682 A 3/1993 Harris
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,275,749 A 1/1994 Kugel et al.
5,276,227 A 1/1994 Wu et al.
5,276,277 A 1/1994 Hightower et al.
5,315,053 A 5/1994 Beach et al.
5,369,196 A 11/1994 Matsumoto et al.
5,382,739 A 1/1995 Atkins et al.
5,436,379 A 7/1995 Heilman et al.
5,462,995 A 10/1995 Hosaka et al.
5,498,815 A 3/1996 Schaerfl, Jr. et al.
5,547,593 A 8/1996 Sanechika et al.
5,602,086 A 2/1997 Le et al.
5,679,812 A 10/1997 Winter et al.
5,688,887 A 11/1997 Bagheri et al.
5,705,577 A 1/1998 Rossi et al.
5,731,254 A 3/1998 Winter et al.
5,807,949 A 9/1998 Rossi et al.
5,811,379 A 9/1998 Rossi et al.
5,846,896 A 12/1998 Ewen
5,852,143 A 12/1998 Sishta et al.
5,858,935 A 1/1999 Watts et al.
5,859,159 A 1/1999 Rossi et al.
5,994,277 A * 11/1999 Ritchie et al. ..... 508/365
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,127,324 A 10/2000 Tolfa et al.
6,133,209 A 10/2000 Rath et al.
6,147,271 A 11/2000 Strebel et al.
6,165,949 A 12/2000 Berlowitz et al.
6,180,575 B1 1/2001 Nipe
6,184,186 B1 2/2001 Ryan et al.
6,267,907 B1 7/2001 Tolfa et al.
6,388,032 B1 5/2002 Yamaura et al.
6,395,948 B1 5/2002 Hope et al.
6,414,090 B2 7/2002 Minami et al.
6,479,722 B1 11/2002 De Wet et al.
6,534,452 B1 * 3/2003 Butler ..... 508/430
6,548,723 B2 4/2003 Bagheri et al.
6,548,724 B2 4/2003 Bagheri et al.
6,589,920 B2 7/2003 Okada et al.
6,642,169 B2 11/2003 Weatherhead
6,646,174 B2 11/2003 Clarembeau
6,706,828 B2 3/2004 DiMaio
6,713,438 B1 3/2004 Baillargeon et al.
6,824,671 B2 11/2004 Goze et al.
6,858,767 B1 2/2005 DiMaio et al.
6,869,917 B2 3/2005 Deckman et al.
7,022,784 B2 4/2006 Wu et al.
7,045,055 B2 5/2006 Ziemer et al.
7,060,768 B2 6/2006 Brookhart et al.
7,129,197 B2 10/2006 Song et al.
7,176,169 B2 2/2007 Gibb et al.
7,312,185 B2 12/2007 Willey et al.
7,544,850 B2 6/2009 Goze et al.
7,547,811 B2 6/2009 Kramer et al.
7,585,823 B2 9/2009 Sullivan et al.
7,592,411 B2 9/2009 Wu et al.
7,592,497 B2 9/2009 Yang et al.
7,683,013 B2 3/2010 Carey et al.
7,732,389 B2 6/2010 Sullivan et al.
7,795,194 B2 9/2010 Iimura et al.
2001/0041817 A1 11/2001 Bagheri et al.
2001/0041818 A1 11/2001 Bagheri et al.
2003/0013623 A1 1/2003 Tse et al.
2003/0055184 A1 3/2003 Song et al.
2003/0092585 A1 5/2003 O'Connor et al.
2003/0158055 A1 8/2003 Deckman et al.
2003/0207775 A1 11/2003 Sullivan et al.
2003/0236177 A1 12/2003 Wu et al.
2004/0002429 A1 1/2004 Forbus, Jr.
2004/0029747 A1 2/2004 Emert et al.
2004/0033908 A1 2/2004 Deckman et al.
2004/0087746 A1 5/2004 Razavi
2004/0092408 A1 5/2004 Willey et al.
2004/0097772 A1 5/2004 Deckers et al.
2004/0147693 A1 7/2004 DiMaio
2004/0220359 A1 11/2004 Abhari et al.
2004/0225088 A1 11/2004 Vaughan et al.
2004/0230016 A1 11/2004 Blackborrow et al.
2005/0059563 A1 3/2005 Sullivan et al.
2005/0101761 A1 5/2005 Lambert et al.
2005/0113621 A1 5/2005 Hope et al.
2005/0124509 A1 6/2005 Gutierrez et al.
2005/0183988 A1 8/2005 Freerks et al.
2005/0250657 A1 11/2005 Wu et al.
2006/0116300 A1 6/2006 Arrowsmith et al.
2006/0116303 A1 6/2006 Iimura et al.
2006/0122073 A1 6/2006 Hewette
2006/0131210 A1 6/2006 Rosenbaum et al.

(56) References Cited

U.S. PATENT DOCUMENTS

| | | | | |
|---|---|---|---|---|
| 2006/0157383 | A1 | 7/2006 | Wu et al. | |
| 2006/0166843 | A1 | 7/2006 | Rajewski et al. | |
| 2006/0178279 | A1 | 8/2006 | Sullivan et al. | |
| 2006/0281643 | A1 | 12/2006 | Habeeb et al. | |
| 2007/0000807 | A1 | 1/2007 | Wu et al. | |
| 2007/0043248 | A1 | 2/2007 | Wu et al. | |
| 2007/0129268 | A1 | 6/2007 | Bell et al. | |
| 2007/0208151 | A1 | 9/2007 | Okada et al. | |
| 2007/0289897 | A1 | 12/2007 | Carey et al. | |
| 2007/0298990 | A1 | 12/2007 | Carey et al. | |
| 2008/0020954 | A1 | 1/2008 | Haigh et al. | |
| 2008/0177121 | A1 | 7/2008 | Wu et al. | |
| 2008/0207475 | A1 | 8/2008 | Haigh et al. | |
| 2008/0300157 | A1* | 12/2008 | Wu et al. | 508/591 |
| 2009/0005279 | A1 | 1/2009 | Wu et al. | |
| 2009/0036725 | A1 | 2/2009 | Wu et al. | |
| 2009/0093657 | A1 | 4/2009 | Buchanan et al. | |
| 2009/0156874 | A1 | 6/2009 | Patil et al. | |
| 2009/0181871 | A1 | 7/2009 | Shah et al. | |
| 2009/0240012 | A1 | 9/2009 | Patil et al. | |
| 2009/0247436 | A1 | 10/2009 | Wardlow et al. | |
| 2009/0253597 | A1 | 10/2009 | Wardlow et al. | |
| 2010/0006259 | A1 | 1/2010 | Mori et al. | |
| 2010/0048438 | A1 | 2/2010 | Carey et al. | |
| 2010/0093571 | A1 | 4/2010 | Paquette et al. | |
| 2010/0256026 | A1 | 10/2010 | Wu et al. | |
| 2010/0292424 | A1 | 11/2010 | Wu et al. | |
| 2011/0082063 | A1 | 4/2011 | Carey et al. | |
| 2011/0136714 | A1 | 6/2011 | Haigh et al. | |

FOREIGN PATENT DOCUMENTS

| | | | |
|---|---|---|---|
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1308496 | B1 | 5/2003 |
| EP | 1342707 | A2 | 9/2003 |
| EP | 1607415 | A1 | 12/2005 |
| EP | 1661921 | A1 | 5/2006 |
| FR | 1464768 | | 1/1967 |
| GB | 938069 | | 9/1963 |
| IN | 191553 | | 12/2003 |
| JP | 6336590 | A | 12/1994 |
| JP | 8302370 | A | 11/1996 |
| JP | 2002020326 | A | 1/2002 |
| JP | 200500446 | A | 7/2005 |
| RU | 2139318 | C1 | 10/1999 |
| WO | 9623751 | | 8/1996 |
| WO | 9804658 | | 2/1998 |
| WO | 9967347 | | 6/1999 |
| WO | 0058423 | | 10/2000 |
| WO | 0214384 | A2 | 2/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2005111178 | A1 | 12/2005 |
| WO | 2006071595 | A2 | 7/2006 |
| WO | 2006083632 | A1 | 8/2006 |
| WO | 2007005094 | A1 | 1/2007 |
| WO | 2007011459 | A1 | 1/2007 |
| WO | 2007011462 | A1 | 1/2007 |
| WO | 2007011832 | A1 | 1/2007 |
| WO | 2007145924 | A1 | 12/2007 |
| WO | 2007146081 | A1 | 12/2007 |
| WO | 2008010865 | A2 | 1/2008 |
| WO | 2009017953 | A2 | 2/2009 |
| WO | 2009123800 | A1 | 10/2009 |
| WO | 2009137264 | A1 | 11/2009 |

OTHER PUBLICATIONS

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis(2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.

J. Wills, "Synthetic Lubricants", Lubrication Fundamentals, Marcel Dekker Inc., New York, 1980, pp. 75-80.

"Mobil Releases SuperSyn PAO's", Lubrication Engineers, 1999, vol. 55, Part 8, pp. 45.

TIBA data, "TIBA datasheet" available on-line at www.albermarle.com on Aug. 26, 2010.

ASTM D3427-03, "Standard Test Method for Air Release Properties of Petroleum Oils".

http://www.mobil.com/USA, Mobilgear® SHC XMP Series.

http://www.famm11c.com/famm/lubricant_product.asp?gearoils&&wPinnacleMarineGear220, Pinnacle® Marine Gear 220.

S.A. Francis, "Saturated Hydrocarbons of High Molecular Weight", Analytical Chemistry, vol. 25, No. 10, Oct. 1953.

"Synthetics, Mineral Oils, and Bio-Based Lubricants Chemistry and Technology", edited by L.R. Rudnick, published by CRC Press, Taylor & Francis, 2006, Chapter 2, Polyinternalolefins, pp. 37-46.

G. Corsico, et al., "Poly(internal olefins)", EURON, Milan, Italy, Chemical Industries (Dekker), 1999, 77(Synthetic Lubricants and High-Performance Functional Fluids, 2nd ed., pp. 53-62.

"Diamines and Higher Amines", The Encyclopedia of Chemical Technology, Decond Edition, Kirk and Othman, vol. 7, Interscience Publishers, 1965, pp. 22-39.

(56) References Cited

OTHER PUBLICATIONS

S. Mitsumoto, "Applications and research trends of high performance base oils for industrial lubric . . . ", Toraiborojisuto, 2007, 52(4), pp. 267-272. Abstract Only.
M. Yagi, "Synthetic lubricants—industrial applications", Junkatsu, 1987, 32(2), pp. 121-125. Abstract Only.
R. Ghio, "Traditional and new lubricants for air compressors", Lubr. Sint., [Atti Conv.], 1984, Meeting date 1983, pp. 193-212, Torviscosa, Italy. Abstract Only.
A. Mastrostefano, et al., "Practical considerations about properties and applications of synthetic lubricants", Lub. Sint., [Atti Conv], 1984, Meeting date 1983, pp. 235-249, Torviscosa, Italy. Abstract Only.

* cited by examiner

ALKYLATED NAPHTYLENE BASE STOCK LUBRICANT FORMULATIONS

This application claims benefit of U.S. Provisional Application 61/278,228 filed Oct. 2, 2009.

BACKGROUND

Oxidation testing is an important part of assessing the potential stability of a lubricant for use in most lubricating applications including air compressors and gear oils. The high volumes of air and high temperatures experienced by a lubricant in an air compressor can have a large affect on the lubricant's oxidative stability. Assessing the stability of a lubricant in oxidation tests are methods by which a formulator can determine the potential stability of a air compressor lubricant in service.

An oxidation test has been developed to determine the length of time it takes for a lubricant to degrade from oxidation or break to a catastrophic increase in viscosity. This method is used to evaluate mineral and synthetic lubricants, with or without additives. The evaluation is based on the resistance of the lubricant to oxidation by air under specified conditions as measured by the changes in viscosity.

The sample is placed in a oxidation cell together with various organometallic catalysts that are dissolved in solution and then placed into the test cell. The cell and its contents are placed in a heating block maintained at a specified temperature, and a measured volume of dried air is bubbled through the test cell held at a pressure ranging from 0-100 psig for the duration of the test, with a air flow rate up to 250 cc/min. A constant temperature block, equipped with an electric heater and thermostatic control capable of maintaining the temperature within ±1° F. (0.5° C.) in the range of 200° F. (93° C.) to 450° F. (232° C.) is used to maintain the specified temperature.

Periodically the test cell is sampled for viscosity, until the oil has oxidized, identified by a rapid increase in oil viscosity. The oil condition is examined by measuring its Kinematic Viscosity at 100° C. Comparisons can then be made to the original Kinematic Viscosity at 100° C. of the oil. Good performance in this test is evidenced by little or no viscosity increase at end of test.

Hydrolytic stability is another important property for determining the stability of lubricants in the presence of moisture. For example, air compressor lubricants are exposed to high moisture levels as a result of normal compressor operations or condensation as the equipment cools after a shut down. Lubricants that are degraded by moisture can lead to increased oil oxidation and decreased lubrication properties which can lead to increased equipment corrosion and damage. ASTM D 2619 is an industry standard for testing hydrolytic stability in lubricants.

The air release properties of a lubricant is a key feature of determining how effective the lubricant is at releasing air from the lubricant after compression. Lubricants with poor air release properties may exhibit increased foaming and poor lubrication properties. All lubricating oil systems contain some air. It can be found in four phases: free air, dissolved air, entrained air and foam. Free air is trapped in a system, such as an air pocket in a hydraulic line. Dissolved air is in solution with the oil and is not visible to the naked eye. Foam is a collection of closely packed bubbles surrounded by thin films of oil that collect on the surface of the oil.

Air entrainment is a small amount of air in the form of extremely small bubbles (generally less than 1.0 mm in diameter) dispersed throughout the bulk of the oil. Agitation of lubricating oil with air in equipment, such as bearings, couplings, gears, pumps, and oil return lines, may produce a dispersion of finely divided air bubbles in the oil. If the residence time in the reservoir is too short to allow the air bubbles to rise to the oil surface, a mixture of air and oil will circulate through the lubricating oil system. This may result in an inability to maintain oil pressure (particularly with centrifugal pumps), incomplete oil films in bearings and gears, and poor hydraulic system performance or failure. Air entrainment is treated differently than foam, and is most often a completely separate problem. A partial list of potential effects of air entrainment include: pump cavitation, spongy, erratic operation of hydraulics, loss of precision control; vibrations, oil oxidation, component wear due to reduced lubricant viscosity, equipment shut down when low oil pressure switches trip, "micro-dieseling" due to ignition of the bubble sheath at the high temperatures generated by compressed air bubbles, safety problems in turbines if overspeed devices do not react quickly enough, and loss of head pressure in centrifugal pumps.

Antifoamants, including silicone additives help produce smaller bubbles in the bulk of the oil. In stagnant systems, the combination of smaller bubbles and greater sheath density can cause serious air entrainment problems. Turbine oil systems with quiescent reservoirs of several thousand gallons may have air entrainment problems with as little as a half a part per million silicone.

Casual exposure to silicone can have a significant effect on the lubricant. There are reports of air entrainment resulting from oil passing through hoses that had been formed on a silicone-coated mandrel. In one instance, in a turbine application, all sources of air were removed, and the system was carefully evaluated, component by component, to check for sources of contamination. After an exhaustive search, the culprit was found to be a silicone coating on electrical cables that were immersed in oil. Other known causes of entrainment problems include contaminants, overadditizing and reservoir design.

One method widely used to test air release properties of petroleum oils is ASTM D 3427-03. This test method measures the time for the entrained air content to fall to the relatively low value of 0.2% volume under a standardized set of test conditions and hence permits the comparison of the ability of oils to separate entrained air under conditions where a separation time is available. The significance of this test method has not been fully established. However, entrained air can cause sponginess and lack of sensitivity of the control of turbine and hydraulic systems. This test may not be suitable for ranking oils in applications where residence times are short and gas contents are high.

In the ASTM D3427 method, compressed air is blown through the test oil, which has been heated to a temperature of 25°, 50°, or 75° C. After the air flow is stopped, the time required for the air entrained in the oil to reduce in volume to 0.2% is recorded as the air release time.

Most solutions to the air entrainment problem have been to redesign the reservoir or choose additives not likely to cause aeration issues. There is a need to create a new formulations utilizing novel base stock combinations that have optimized improved oxidation, hydrolytic stability and air release properties while maintaining other favorable lubricating properties. Accordingly, this invention satisfies that need.

SUMMARY

In one embodiment a novel lubricant is disclosed. The lubricant comprises an alkylated naphthalene base stock with a viscosity of at least 2 cSt and less than 22 cSt kv 100° C., the alkylated naphthalene base stock is greater than 55 weight percent of the lubricant, a PAO base stock with at least 4 cSt and less than 250 cSt kv100° C., the PAO base stock is at least 2 and less than 40 weight percent of the lubricant, at least 0.5 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv100° C., less than 10 ppm metals, less than 100 ppm sulfur, and a VI greater than 70.

In a second embodiment a method for blending a novel lubricant formulation is disclosed. The method comprises obtaining an alkylated naphthalene base stock with a viscosity of at least 2 cSt and less than 22 cSt kv100° C., obtaining a PAO base stock with at least 4 cSt and less than 250 cSt kv100° C., obtaining an amine antioxidant additive, a defoamant additive, and an alkylated rust inhibitor, and blending the base stocks and additives to obtain a lubricant wherein the alkylated naphthalene base stock is greater than 55 weight percent of the lubricant, the PAO base stock is at least 2 and less than 40 weight percent of the lubricant, at least 0.5 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv100° C., less than 10 ppm metal content, less than 100 ppm sulfur, and a VI greater than 70.

In a third embodiment, a method to improve oxidation in air compressor lubricants is disclosed. The method comprises obtaining a lubricant having an alkylated naphthalene base stock with a viscosity of at least 2 cSt and less than 22 cSt kv100° C., the alkylated naphthalene base stock is greater than 55 weight percent of the lubricant, a PAO base stock with at least 4 cSt and less than 250 cSt kv100° C., the PAO base stock is at least 2 and less than 40 weight percent of the lubricant, at least 0.5 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv100° C., less than 10 ppm metal content, less than 100 ppm sulfur, and a VI greater than 70 and lubricating the air compressor with the lubricant to achieve favorable oxidation properties in operating air compressors.

In a fourth embodiment, a method to achieve favorable air release in air compressors is disclosed. The method comprises obtaining a lubricant having an alkylated naphthalene base stock with a viscosity of at least 2 cSt and less than 22 cSt kv 100° C., the alkylated naphthalene base stock is greater than 55 weight percent of the lubricant, a PAO base stock with at least 4 cSt and less than 250 cSt kv 100° C., the PAO base stock is at least 2 and less than 40 weight percent of the lubricant, at least 0.5 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv 100° C., less than 10 ppm metal content, less than 100 ppm sulfur, and a VI greater than 70 and lubricating the air compressor with the lubricant to achieve favorable air release properties in an operating air compressor.

In a fifth embodiment, a method to improve hydrolytic stability of lubricants in air compressors is disclosed. The method comprises obtaining a lubricant having an alkylated naphthalene base stock with a viscosity of at least 2 cSt and less than 22 cSt kv100° C., the alkylated naphthalene base stock is greater than 55 weight percent of the lubricant, a PAO base stock with at least 4 cSt and less than 250 cSt kv 100° C., the PAO base stock is at least 2 and less than 40 weight percent of the lubricant, at least 0.05 and less than 1.5 weight percent of the lubricant is an amine antioxidant additive, at least 0.5 and less than 1.5 weight percent of the lubricant is a defoamant additive, at least 0.1 and less than 0.4 weight percent of the lubricant is an alkylated rust inhibitor additive, and the lubricant has a viscosity of at least 4 cSt and less than 10 cSt kv100° C., less than 10 ppm metal content, less than 100 ppm sulfur, and a VI greater than 70 and lubricating the air compressor with the lubricant to achieve favorable hydrolytic stability properties in an operating air compressor.

DETAILED DESCRIPTION

Figure 1:
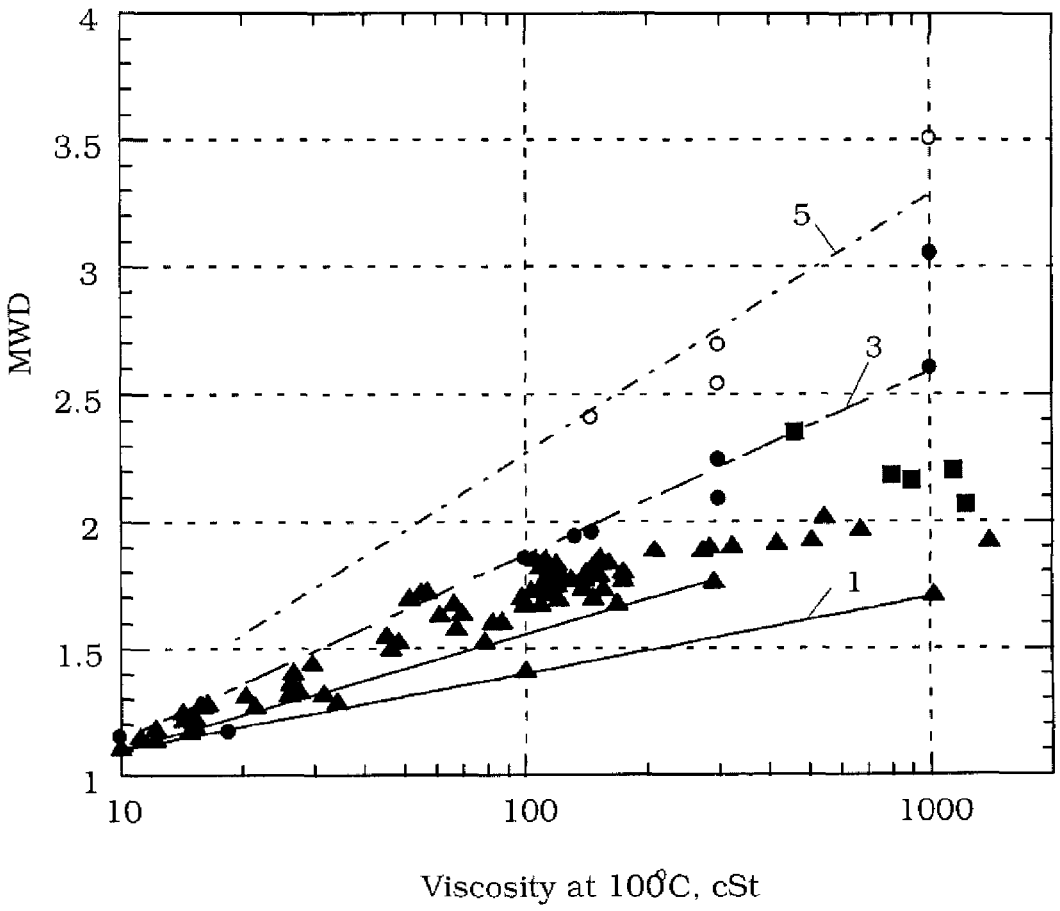
FIG. 1 is a graph illustrating the molecular weight distribution of high viscosities PAO.

In this patent, unless specified otherwise, all base stock viscosities are referred to their 100° C. kinematic viscosity in cSt as measured by ASTM D445 method. The ISO viscosity classification which is typically cited for industrial lubes of finished lubricants based on kinematic viscosities observed at 40° C. We have discovered novel combinations of base stocks that provide unexpected favorable improvements in lubricating properties. In various embodiments these properties include favorable improvements in oxidation, hydrolytic stability, shear stability, air release, pour point, temperature control, viscosity loss and energy efficiency. In U.S. Provisional Application No. 60/811,273, we have discovered a novel combination of base stocks that provides an unexpected increase in aeration properties, shear stability and energy efficiency. In U.S. Provisional Application No. 60/811,207, we have discovered the benefits of using metallocene catalyzed PAO compared to the prior art PAO.

In one embodiment, this novel discovery is based on wide "bi-modal" and "extreme-modal" blends of oil viscosities which are base stock viscosity differences of at least 20 cSt, preferably at least 40 cSt, and possibly greater than 100 cSt, respectively. In the extreme modal blend the high viscosity is at least 100 cSt, and the low viscosity base stock is less than 22 cSt. Kinematic Viscosity is determined by ASTM D-445 method by measuring the time for a volume of liquid to flow under gravity through a calibrated glass capillary viscometer. Viscosity is typically measured in centistokes (cSt, or $mm^2/s$) units. The ISO viscosity classification which is typically cited for industrial lubes based on viscosities observed at 40° C.

Base stock oils used to blend finished oils, are generally described using kinematic viscosities observed at 100° C.

This "bi-modal" blend of viscosities also provides a temperature benefit by lowering the lubricant operating temperature in gear testing. This temperature drop would provide increased efficiency boosts and extended seal life.

In the past, high viscosity base stocks have not been practical from some applications due to shear stability problems resulting in viscosity loss in service due to breakdown of polymeric chains. We have discovered that new base stocks with low narrow molecular weight distributions provide excellent shear stability. This discovery provided the ability to utilize high viscosity base stocks in blending modes that can be described as "dumbbell", "bi-modal" and "extreme-modal".

In a preferred embodiment, the new base stocks are produced according to the method described in U.S. Provisional Application No. 60/650,206. These base stocks are known as metallocene catalyzed bases stocks and are described in detail below.

Metallocene Base Stocks

In one embodiment, the metallocene catalyzed PAO (or mPAO) used for this invention can be a co-polymer made from at least two alpha-olefins or more, or a homo-polymer made from a single alpha-olefin feed by a metallocene catalyst system.

This copolymer mPAO composition is made from at least two alpha-olefins of C3 to C30 range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate tacticity. These copolymers have useful lubricant properties including excellent VI, pour point, low temperature viscometrics by themselves or as blend fluid with other lubricants or other polymers. Furthermore, these copolymers have narrow molecular weight distributions and excellent lubricating properties.

In an embodiment, mPAO is made from the mixed feed LAOs (linear alpha olefin) comprising at least two and up to 26 different linear alpha-olefins selected from C3 to C30 linear alpha-olefins. In a preferred embodiment, the mixed feed LAO is obtained from an ethylene growth process using an aluminum catalyst or a metallocene catalyst. The growth olefins comprise mostly C6 to C18-LAO. LAOs from other process, such as the SHOP process, can also be used.

This homo-polymer mPAO composition is made from single alpha-olefin chosing from C3 to C30 range, preferably C3 to C16, most preferably C3 to C14 or C3 to C12. The homo-polymers of the invention can be isotactic, atactic, syndiotactic polymers or any combination of these tacticity or other form of appropriate tacticity. Often the tacticity can be carefully tailored by the polymerization catalyst and polymerization reaction condition chosen or by the hydrogenation condition chosen. These homo-polymers have useful lubricant properties including excellent VI, pour point, low temperature viscometrics by themselves or as blend fluid with other lubricants or other polymers. Furthermore, these homo-polymers have narrow molecular weight distributions and excellent lubricating properties.

In another embodiment, the alpha-olefin(s) can be chosen from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Trosch synthesis (as reported in U.S. Pat. No. 5,382,739). For example, C3 to C16-alpha-olefins, more preferably linear alpha-olefins, are suitable to make homo-polymers. Other combinations, such as C4 and C14-LAO; C6 and C16-LAO; C8, C10, C12-LAO; or C8 and C14-LAO; C6, C10, C14-LAO; C4 and C12-LAO, etc. are suitable to make co-polymers.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion and optionally with co-activators, typically trialkylaluminum compounds.

According to the invention, a feed comprising a mixture of LAOs selected from C3 to C30 LAOs or a single LAO selected from C3 to C16 LAO, is contacted with an activated metallocene catalyst under oligomerization conditions to provide a liquid product suitable for use in lubricant components or as functional fluids. This invention is also directed to a copolymer composition made from at least two alpha-olefins of C3 to C30 range and having monomers randomly distributed in the polymers. The phrase "at least two alpha-olefins" will be understood to mean "at least two different alpha-olefins" (and similarly "at least three alpha-olefins" means "at least three different alpha-olefins", and so forth).

In preferred embodiments, the average carbon number (defined hereinbelow) of said at least two alpha-olefins in said feed is at least 4.1. In another preferred embodiment, the amount of ethylene and propylene in said feed is less than 50 wt % individually or preferably less than 50 wt % combined. A still more preferred embodiment comprises a feed having both of the aforementioned preferred embodiments, i.e., a feed having an average carbon number of at least 4.1 and wherein the amount of ethylene and propylene is less than 50 wt % individually.

In embodiments, the product obtained is an essentially random liquid copolymer comprising the at least two alpha-olefins. By "essentially random" is meant that one of ordinary skill in the art would consider the products to be random copolymer. Other characterizations of randomness, some of which are preferred or more preferred, are provided herein. Likewise the term "liquid" will be understood by one of ordinary skill in the art, but more preferred characterizations of the term are provided herein. In describing the products as "comprising" a certain number of alpha-olefins (at least two different alpha-olefins), one of ordinary skill in the art in possession of the present disclosure would understand that what is being described in the polymerization (or oligomerization) product incorporating said certain number of alpha-olefin monomers. In other words, it is the product obtained by polymerizing or oligomerizing said certain number of alpha-olefin monomers.

This improved process employs a catalyst system comprising a metallocene compound (Formula 1, below) together with an activator such as a non-coordinating anion (NCA) (Formula 2, below) and optionally a co-activator such as a trialkylaluminum, or with methylaluminoxane (MAO) (Formula 3, below).

Formula 1

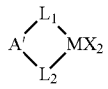

Formula 2

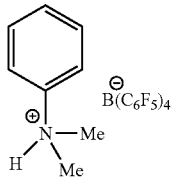

NCA

Formula 3

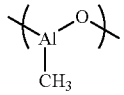

MAO

The term "catalyst system" is defined herein to mean a catalyst precursor/activator pair, such as a metallocene/activator pair. When "catalyst system" is used to describe such a pair before activation, it means the unactivated catalyst (pre-catalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkylaluminum compound, is also used as impurity scavenger.

The metallocene is selected from one or more compounds according to Formula 1, above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated, A can be no atom, as in many un-bridged metallocenes or A is an optional bridging group which if present, in preferred embodiments is selected from dialkylsilyl, dialkylmethyl, diphenylsilyl or diphenylmethyl, ethylenyl (—CH2-CH2-), alkylethylenyl (—CR2-CR2-), where alkyl can be independently C1 to C16 alkyl radical or phenyl, tolyl, xylyl radical and the like, and wherein each of the two X groups, Xa and Xb, are independently selected from halides, OR (R is an alkyl group, preferably selected from C1 to C5 straight or branched chain alkyl groups), hydrogen, C1 to C16 alkyl or aryl groups, haloalkyl, and the like. Usually, relatively more highly substituted metallocenes give higher catalyst productivity and wider product viscosity ranges and are thus often more preferred.

In another embodiment, any of the polyalpha-olefins produced herein preferably have a Bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins produced herein are hydrogenated and have a Bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins described herein may have monomer units represented by the formula, in addition to the all regular 1,2-connection.

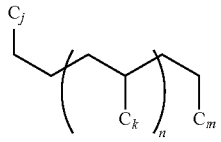

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR In another embodiment, any of the polyalpha-olefins described herein preferably have an Mw (weight average molecular weight) of 100,000 or less, preferably between 100 and 80,000, preferably between 250 and 60,000, preferably between 280 and 50,000, preferably between 336 and 40,000 g/mol.

In another embodiment, any of the polyalpha-olefins described herein preferably have an Mn (number average molecular weight) of 50,000 or less, preferably between 200 and 40,000, preferably between 250 and 30,000, preferably between 500 and 20,000 g/mol.

In another embodiment, any of the polyalpha-olefins described herein preferably have a molecular weight distribution (MWD=Mw/Mn) of greater than 1 and less than 5, preferably less than 4, preferably less than 3, preferably less than 2.5. The MWD of mPAO is always a function of fluid viscosity. Alternately any of the polyalpha-olefins described herein preferably have an Mw/Mn of between 1 and 2.5, alternately between 1 and 3.5, depending on fluid viscosity.

The Mw, Mn and Mz are measured by a GPC method using a column for medium to low molecular weight polymers, tetrahydrofuran as solvent and polystyrene as calibration standard, correlated with the fluid viscosity according to a power equation.

In a preferred embodiment of this invention, any PAO described herein may have a pour point of less than 0° C. (as measured by ASTM D 97), preferably less than −10° C., preferably less than −20° C., preferably less than −25° C., preferably less than −30° C., preferably less than −35° C., preferably less than −50°, preferably between −10 and −80° C., more preferably between −15° C. and −70° C.

In a preferred embodiment of this invention, any PAO described herein may have a kinematic viscosity (at 100° C. as measured by ASTM D 445) from about 4 to about 50,000 cSt, preferably from about 5 cSt to about 30,000 cSt at 100° C., alternately from about 4 to about 100,000 cSt, preferably from about 6 cSt to about 50,000 cSt, preferably from about 10 cSt to about 30,000 cSt at 100° C.

In another embodiment, any polyalpha-olefin described herein may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 6 cSt to about 500 cSt as measured by ASTM D445. The PAOs preferably have viscosities in the range of 2 to 500 cSt at 100° C. in one embodiment, and from 2 to 3000 cSt at 100° C. in another embodiment, and from 3.2 to 300 cSt in another embodiment. Alternately, the polyalpha-olefin has a KV100 of less than 200 cSt.

In another embodiment, any polyalpha olefin described herein may have a kinematic viscosity at 100° C. from 3 to 10 cSt and a flash point of 150° C. or more, preferably 200° C. or more (as measured by ASTM D 56).

In another embodiment, any polyalpha olefin described herein may have a dielectric constant of 2.5 or less (1 kHz at 23° C. as determined by ASTM D 924).

In another embodiment, any polyalpha olefin described herein may have a specific gravity of 0.75 to 0.96 g/cm$^3$, preferably 0.80 to 0.94 g/cm$^3$.

In another embodiment, any polyalpha olefin described herein may have a viscosity index (VI) of 100 or more, preferably 120 or more, preferably 130 or more, alternately, from 120 to 450, alternately from 100 to 400, alternately from 120 to 380, alternately from 100 to 300, alternately from 140 to 380, alternately from 180 to 306, alternately from 252 to 306, alternately the viscosity index is at least about 165, alternately at least about 187, alternately at least about 200, alternately at least about 252. For many lower viscosity fluids made from 1-decene or 1-decene equivalent feeds (KV100° C. of 3 to 10 cSt), the preferred VI range is from 100 to 180. Viscosity index is determined according to ASTM Method D 2270-93 [1998].

All kinematic viscosity values reported for fluids herein are measured at 100° C. unless otherwise noted. Dynamic viscosity can then be obtained by multiplying the measured kinematic viscosity by the density of the liquid. The is units for kinematic viscosity are in m$^2$/s, commonly converted to cSt or centistokes (1 cSt=10-6 m$^2$/s or 1 cSt=1 mm$^2$/sec).

One embodiment is a new class of polyalpha-olefins, which have a unique chemical composition characterized by a high degree of linear branches and very regular structures with some unique head-to-head connections at the end position of the polymer chain. The polyalpha-olefins, whether homo-polymers or co-polymers, can be isotactic, syndiotactic or atactic polymers, or have combination of the tacticity. The new polyalpha-olefins when used by themselves or blended with other fluids have unique lubrication properties.

One embodiment is a new class of polyalpha-olefins, which have a unique chemical composition characterized by a high degree of linear branches and very regular structures with some unique head-to-head connections at the end position of the polymer chain. These compositions have branch ratios of CH3/CH2<0.19. This branch ratio or CH3/CH2 ratio in the polymer fraction is calculated from the weight fractions of methyl groups obtained by infrared analysis method published in Analytical Chemistry, Vol. 25, No. 10, P. 1466 (1953).

Branch ratio=(wt fraction of methyl group)/(1−(wt fraction of methyl group))

Another embodiment is a new class of hydrogenated polyalpha-olefins having a unique composition which is characterized by a high percentage of unique head-to-head connection at the end position of the polymer and by a reduced degree tacticity compared to the product before hydrogenation. The new polyalpha-olefins when used by itself or blended with another fluid have unique lubrication properties.

This improved process to produce these polymers employs metallocene catalysts together with one or more activators (such as an alumoxane or a non-coordinating anion) and optionally with co-activators such as trialkylaluminum compounds. The metallocene catalyst can be a bridged or unbridged, substituted or unsubstituted cyclopentadienyl, indenyl or fluorenyl compound. One preferred class of catalysts are highly substituted metallocenes that give high catalyst productivity and higher product viscosity. Another preferred class of metallocenes are bridged and substituted cyclopentadienes. Another preferred class of metallocenes are bridged and substituted indenes or fluorenes. One aspect of the processes described herein also includes treatment of the feed olefins to remove catalyst poisons, such as peroxides, oxygen, sulfur, nitrogen-containing organic compounds, and or acetylenic compounds. This treatment is believed to increase catalyst productivity, typically more than 5 fold, preferably more than 10 fold.

A preferred embodiment is a process to produce a polyalpha-olefin comprising:

1) contacting at least one alpha-olefin monomer having 3 to 30 carbon atoms with a metallocene compound and an activator under polymerization conditions wherein hydrogen, if present, is present at a partial pressure of 200 psi (1379 kPa) or less, based upon the total pressure of the reactor (preferably 150 psi (1034 kPa) or less, preferably 100 psi (690 kPa) or less, preferably 50 psi (345 kPa) or less, preferably 25 psi (173 kPa) or less, preferably 10 psi (69 kPa) or less (alternately the hydrogen, if present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less), and wherein the alpha-olefin monomer having 3 to 30 carbon atoms is present at 10 volume % or more based upon the total volume of the catalyst/activator/co-activator solutions, monomers, and any diluents or solvents present in the reaction; and 2) obtaining a polyalpha-olefin, optionally hydrogenating the PAO, and obtaining a PAO, comprising at least 50 mole % of a C3 to C30 alpha-olefin monomer, wherein the polyalpha-olefin has a kinematic viscosity at 100° C. of 5000 cSt or less, and the polyalpha-olefin comprises Z mole % or more of units represented by the formula:

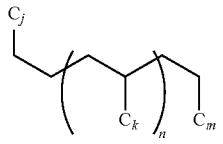

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350, and An alternate embodiment is a process to produce a polyalpha-olefin comprising:

1) contacting a feed stream comprising one or at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds; and obtaining a polyalpha-olefin comprising at least 50 mole % of a C5 to C24 alpha-olefin monomer where the polyalpha-olefin has a kinematic viscosity at 100° C. of 5000 cSt or less. Preferably, hydrogen, if present is present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

An alternate embodiment is a process to produce a polyalpha-olefin comprising:

1) contacting a feed stream comprising at least one alpha-olefin monomer having 3 to 30 carbon atoms with a metallocene catalyst compound and a non-coordinating anion activator or alkylalumoxane activator, and optionally an alkylaluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds which; and obtaining a polyalpha-olefin comprising at least 50 mole % of a C5 to C24 alpha-olefin monomer where the polyalpha-olefin has a kinematic viscosity at 100° C. of 5000 cSt or less; Alternately, in this process described herein hydrogen, if present, is present in the reactor at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

2) isolating the lube fraction polymers and then contacting this lube fraction with hydrogen under typical hydrogenation conditions with hydrogenation catalyst to give fluid with bromine number below 1.8, or alternatively, isolating the lube fraction polymers and then contacting this lube fraction with hydrogen under more severe conditions with hydrogenation catalyst to give fluid with bromine number below 1.8 and with reduce mole % of mm components than the unhydrogenated polymers. The hydrogen pressure for this process is usually in the range from 50 psi to 3000 psi, preferably 200 to 2000 psi, preferably 500 to 1500 psi.

Molecular Weight Distribution (MWD)

Molecular weight distribution is a function of viscosity. The higher the viscosity the higher the molecular weight distribution. FIG. 1 is a graph showing the molecular weight distribution as a function of viscosity at kv100° C. The circles represent the prior art PAO. The squares and upper triangles represent the new metallocene catalyzed PAOs. Line 1 represents the preferred lower range of molecular weight distribution for the high viscosity metallocene catalyzed PAO. Line 3 represents preferred upper range of the molecular weight distribution for the high viscosity metallocene catalyzed PAO. Therefore, the region bounded by lines 1 and 3 represents the preferred molecular weight distribution region of the new metallocene catalyzed PAO. Line 2 represents the desirable and typical MWD of actual experimental samples of the metallocene PAO made from 1-decene. Line 5 represents molecular weight distribution of the prior art PAO.

Equation 1 represents the algorithm for line 5 or the average molecular weight distribution of the prior art PAO. Whereas equations 2, 3, and 4 represent lines 1, 2 and 3 respectively.

$$MWD=0.222+1.0232*\log(Kv \text{ at } 100^\circ \text{ C. in cSt}) \quad \text{Eq. 1}$$

$$MWD=0.41667+0.725*\log(Kv \text{ at } 100^\circ \text{ C. in cSt}) \quad \text{Eq. 2}$$

$$MWD=0.8+0.3*\log(Kv \text{ at } 100^\circ \text{ C. in cSt}) \quad \text{Eq. 3}$$

$$MWD=0.66017+0.44922*\log(Kv \text{ at } 100^\circ \text{ C. in cSt}) \quad \text{Eq. 4}$$

In at least one embodiment, the molecular weight distribution is at least 10 percent less than equation 1. In a preferred embodiment the molecular weight distribution is less than equation 2 and in a most preferred embodiment the molecular weight distribution is less than equation 2 (*is 2 the correct number **) and more than equation 4.

Table 1 is a table demonstrating the differences between metallocene catalyzed PAO ("mPAO") and current high viscosity prior art PAO (cHVI-PAO). Examples 1 to 8 in Table 1 were prepared from different feed olefins using metallocene catalysts. The metallocene catalyst system, products, process and feeds were described in Patent Applications Nos. PCT/US2006/021399 and PCT/US2006/021231. The mPAOs samples in Table 1 were made from C10, C6,12, C6 to C18, C6,10,14-LAOs. Examples 1 to 7 all have very narrow molecular weight distribution (MWD). The MWD of mPAO depends on fluid viscosity as shown in FIG. 1.

TABLE 1

| Example No. | 1 | 2 | 3 | 4 | 5 | 6 | 7 | 8 | 9 | 10 | 11 |
|---|---|---|---|---|---|---|---|---|---|---|---|
| sample type | mPAO | mPAO | mPAO | mPAO | mPAO | mPAO | mPAO | mPAO | cHVI-PAO | cHVI-PAO | cHVI-PAO |
| Feed LAO | C6/C12 | C6-C18 | C6-C18 | C10 | C6, 10, 14 | C6, 10, 14 | C10 | C10 | C10 | C10 | C10 |
| 100° C. Kv, cS | 150 | 151 | 540 | 671 | 460 | 794.35 | 1386.63 | 676.1 | 150 | 300 | 1,000 |
| 40° C. Kv, cS | 1701 | 1600 | 6642 | 6900 | 5640 | 10318 | 16362 | 5743 | 1500 | 3100 | 10,000 |
| VI | 199 | 207 | 257 | | 248 | 275 | 321 | 303 | 218 | 241 | 307 |
| Pour, ° C. | −33 | −36 | −21 | −18 | nd | nd | | −12 | −33 | −27 | −18 |
| MWD by GPC | | | | | | | | | | | |
| Mw | 7,409 | 8,089 | 17,227 | 19772 | 16149 | 20273 | 31769 | 29333 | 8,974 | 12,511 | 32,200 |
| MWD | 1.79 | 2.01 | 1.90 | 1.98 | 2.35 | 2.18 | 1.914 | 5.50 | 2.39 | 2.54 | 4.79 |
| % Visc Change by TRB Test (a) | | | | | | | | | | | |
| 20 hrs | −0.33 | −0.65 | −2.66 | −3.64 | −4.03 | −8.05 | −19.32 | −29.11 | −7.42 | −18.70 | −46.78 |
| 100 hrs | −0.83 | −0.70 | −1.07 | 1.79 | nd | nd | nd | nd | nd | −21.83 | −51.09 |

(a) CEC L-45-A-99 Taper Roller Bearing/C (20 hours) (KRL test 20 hours) at SouthWest Research Institute When examples 1 to 7 samples were subjected to tapered roller bearing ("TRB") test, they show very low viscosity loss after 20 hours shearing or after 100 hours of extended shearing (TRB). Generally, shear stability is a function of retention of fluid viscosity. Lower viscosity fluids have minimal viscosity losses of less than 10%. When fluid viscosity is above 1000 cSt as in Example 7, the fluid loss is approximately 19% viscosity. Example 8 is a metallocene PAO with MWD of 5.5. This metallocene PAO shows significant amount of viscosity loss at 29%.

Examples 9, 10 and 11 are comparative examples. The high viscosity PAO are made according to methods described in U.S. Pat. Nos. 4,827,064 and 4,827,073. They have broad MWD and therefore poor shear stability in the TRB test.

Figure 2:
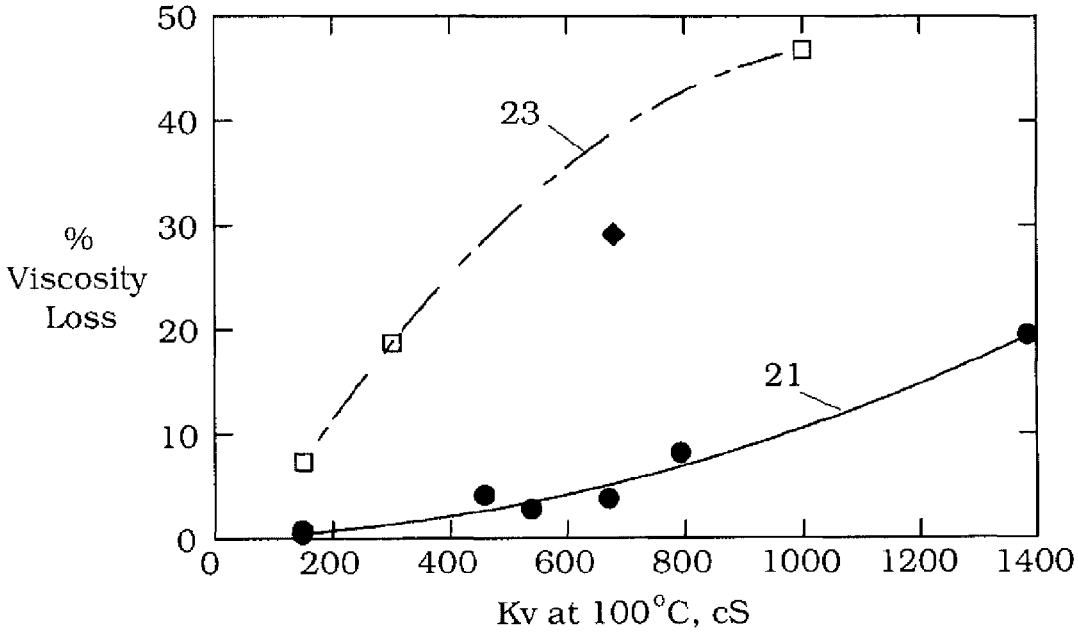
FIG. 2 is a graph illustrating the improved viscosities losses or improved shear stability as a function of the viscosity of the high viscosity metallocene catalyzed base stocks.

The comparison of shear stability as a function of fluid viscosity for mPAO with narrow MWD vs. cHVI-PAO is summarized in FIG. 2. This graph demonstrates that the mPAO profile shown as line 21 has much improved shear stability over wide viscosity range when compared to the cHVI-PAO profile shown as line 23.

These examples demonstrated the importance of MWD effect on shear stability. Accordingly, the higher viscosity base stocks with tighter molecular weight distributions provide favorable shear stability even at high viscosities.

The aromatic group itself should have at least about 6 carbon atoms, preferably at least about 8, and still more preferably at least about 10 carbon atoms. The alkyl groups on the alkylnaphthalene preferably have from about 6 to 30 carbon atoms, with particular preference to about 12 to 18 carbon atoms. A preferred class of alkylating agents are the olefins with the requisite number of carbon atoms, for example, the hexenes, heptenes, octenes, nonenes, decenes, undecenes, dodecenes. Mixtures of the olefins, e.g. mixtures of C.sub.12-C.sub.20 or C.sub.14-C.sub.18 olefins, are useful. Branched alkylating agents, especially oligomerized olefins such as the trimers, tetramers, pentamers, etc., of light olefins such as ethylene, propylene, the butylenes, etc., are also useful.

Lubricant Formulation

In one embodiment, the formulation is based on blends of high viscosity synthetic Group IV PAOs with alkylated naphthalene. In a preferred embodiment, a High Viscosity Index, metallocene-catalyzed PAO of greater than 50 cSt is blended with a low-viscosity Group V alkylated aromatic, or alkylated naphthalene base stock. A detailed description of suitable Group V base stocks can be found in "Synthetics, Mineral Oils and Bio-Based Lubricants, Chemistry and Technology" Edited by L. R. Rudnick, published by CRC Press, Taylor & Francis, 2005. The alkylated aromatics of choice are alkylbenzene, alkylated naphthalene and other alkylated aromatics such as alkylated diphenylether, diphenylsulfide, biphenyl, etc. We have found that this unique base stock combination can impart enhanced oxidation, gear efficiency, improved air-release property and decrease in operating temperature.

Also, unexpected and significant air release benefits result from this discovery. Specifically, decreased air release times according to ASTM D 3427. These air release benefits are manifest in a decrease of as much as 75% of the standard release times of gear oil viscosity-grade lubricants. In addition to the above mentioned benefits, we also discovered, significant improvements in low temperature performance (reduction in pour point), hydrolytic stability and enhanced pumpability at low temperatures.

In one preferred embodiment, the final lubricant preferable comprises an alkylated naphthalene lubricant base stock having a viscosity of at least 2 cSt and less than 22 cSt. A second base stock is PAO with a viscosity of at least 2 cSt and less than 250 cSt. Even more preferably the PAO has a viscosity less than 125 cSt, an amine antioxidant additive, a defoamant additive, at least 0.1 and less than 0.4 weight percent of the compressor oil is an alkylated rust inhibitor additive. The fully formulated lubricant having a viscosity of at least 4 cSt and less than 10 cSt kv100° C., less than 10 ppm metal content, less than 100 ppm sulfur content, and a VI greater than 70.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV bases stock includes polyalphaolefins (PAO). Group V base stocks include synthetic base stocks not included in Groups I-IV. Table 3 summarizes properties of each of these five groups. All discussion of Gr I to V base stocks can be found in "Synthetics, Mineral Oils and Bio-Based Lubricants, Chemistry and Technology" Edited by L. R. Rudnick, published by CRC Press, Taylor & Francis, 2005.

In Table 2 under Group V base stocks are Polyinternal olefins ("PIO"). Polyinternal olefins are long-chain hydrocarbons, typically a linear backbone with some branching randomly attached; they are obtained by oligomerization of internal n-olefins. The catalyst is usually a BF3 complex with a proton source that leads to a cationic polymerization, or promoted BF3 or AlCl3 catalyst system. The process to produce polyinternal olefins consists of four steps: reaction, neutralization/washing, hydrogenation and distillation. These steps are somewhat similar to PAO process. PIO's are typically available in low viscosity grades, 4 cSt, 6 cSt and 8 cSt. If necessary, low viscosity, 1.5 to 3.9 cSt can also be made conveniently by the BF3 process or other cationic processes. Typically, the n-olefins used as starting material are n-C12-C18 internal olefins, more preferably, n-C14-C16 olefins are used. PIO can be made with VI and pour points very similar to PAO, only slightly inferior. They can be used in engine and industrial lubricant formulations. For more detailed discussion, see Chapter 2, Polyinternalolefins in the book, "Synthetics, Mineral Oils, and Bio-Based Lubricants—Chemistry and Technology" Edited by Leslie R. Rudnick, p. 37-46, published by CRC Press, Taylor & Francis Group, 2006; or "Polyinternal Olefins" by Corsico, G.; Mattei, L.; Roselli, A.; Gommellini, Carlo. EURON, Milan, Italy. Chemical Industries (Dekker) (1999), 77 (Synthetic Lubricants and High-Performance Functional Fluids, (2nd Edition)), 53-62. Publisher: Marcel Dekker, Inc. PIO was classified by itself as Group VI fluid in API base stock classification.

TABLE 2

| Base Stock Properties | | | |
|---|---|---|---|
| | Saturates | Sulfur | Viscosity Index |
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |

In a preferred embodiment, the base stocks include at least one base stock of synthetic oils and most preferably include at least one base stock of API group IV Polyalpha-olefins. Synthetic oil for purposes of this application shall include all oils that are not naturally occurring mineral oils. Naturally occurring mineral oils are often referred to as API Group I oils.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant base stocks and, with higher viscosity grades; as VI improvers. They are referred to as High Viscosity Index PAOs or HVI-PAOs. The relatively low molecular weight high viscosity PAO materials were found to be useful as lubricant base stocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived base stocks.

Various modifications and variations of these high viscosity PAO materials are also described in the following U.S. Patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: C30-C1300 hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 5 to 5000 cSt. In another embodiment, viscosities of the HVI-PAO oligomers measured at 100° C. range from 3 cSt to 15,000 cSt. Furthermore, the fluids with viscosity at 100° C. of 3 cSt to 5000 cSt have a VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of C6-C20 1-alkenes. Examples of the feeds can be 1-hexene, 1-octene, 1-decene, 1-dodecene, 1-tetradecene, etc. or mixture of C6 to C14 1-alkenes or mixture of C6 to C20 1-alkenes, C6 and C12 1-alkenes, C6 and C14 1-alkenes, C6 and C16 1-alkenes, C6 and C18 1-alkenes, C8 and C10 1-alkenes, C8 and C12 1-alkenes, C8, C10 and C12 1-alkenes, and other appropriate combinations.

The lube products usually are distilled to remove any low molecular weight compositions such as those boiling below 600° F., or with carbon numbers less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, etc. The amount of the double bonds or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

It was known that, usually, the oxidative stability and light or UV stability of fluids improves when the amount of unsaturation double bonds or olefinic contents is reduced. Therefore it is necessary to further hydrotreat the polymer if they have high degree of unsaturation. Usually, the fluids with bromine number of less than 5, as measured by ASTM D1159, is suitable for high quality base stock application. Of course, the lower the bromine number, the better the lube quality. Fluids with bromine number of less than 2 or 3 are common. The most preferred range is less than 1 or less than 0.1. The method to hydrotreat to reduce the degree of unsaturation is well known in literature [U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, we can chose to use as is without hydrotreating, or we can choose to hydrotreating to further improve the base stock properties.

Another type of PAO, classified as Group IV base stock and used extensively in many synthetic or partial synthetic industrial lubricants, is produced by oligomerization or polymerization of linear alpha-olefins of C6 to C16 by promoted BF3 or AlCl3 catalysts. This type of PAO is available in many viscosity grades ranging from 1.7 cSt to 100 cSt from ExxonMobil Chemical Company.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of similar base oils. For purposes of this application synthetic bases stocks shall include Group II, Group III, group IV and Group V base stocks.

A more specific example embodiment, is the combination of high viscosity metallocene catalyzed PAO having a molecular weight distribution (MWD) as a function of viscosity at least 10 percent less than the algorithm: is [MWD=0.2223+1.0232*log(kv at 100° C. in cSt)] with a low viscosity Polyalpha-olefin including PAOs with a viscosity of less than 6 cSt, and more preferably with a viscosity between 1.5 cSt or 4 cSt, Kv100° C. and even more preferably with a small amount of Group V base stocks, including esters, polyalkylene glycols, or alkylated aromatics. The Group V base stocks can be used as an additional base stock or as a co-base stock with either the first and second base stocks for additive solubility. The preferred ester is an adipate ester, TMP ester, a polyol ester or aromatic ester, such as a phthalate ester. The preferred alkyl aromatics are alkylbenzenes or alkylnaphthalenes. The preferred polyalkylene glycols are liquid polymers or copolymers made from ethylene oxide, propylene oxide, butylenes oxides or higher alkylene oxides with some degree of compatibility with PAO, other hydrocarbon fluids, GTL or mineral oils.

In one embodiment, Gas to liquid (GTL) base stocks can also be preferentially used with the components of this invention as a portion of the base stocks used to formulate the finished lubricant. GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example, waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates and may contain mixtures of mono-cycloparaffins and multi-cycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

We have discovered that this unique base stock combination can impart even further favorable properties when combined with specific additive systems. The additives include various commercially available additive packaged including gear oil packages. These additive packages include a high performance series of components that include antiwear, antioxidant, defoamant, demulsifier, detergent, dispersant, metal passivation, and rust inhibition additive chemistries to deliver desired performance.

We have discovered a new and novel lubricant formulations preferably for gear oils and compressor oils and more preferentially for use in rotary screw compressors. In one embodiment, these formulations require greater than 55 weight percent of alkylated aromatic compounds and a lesser amount of PAO.

The additives may be chosen to modify various properties of the lubricating oils. For gear oils, the additives should also preferably provide the following properties, antiwear protection, rust protection, micropitting protection, friction reduction, and improved filterability. Details of suitable additives are described below. Persons skilled in the art with the benefit of the discourse herein will recognize various additives that can be chosen to achieve favorable properties including favorable properties for air compressors and gear oil applications.

Figure 3:
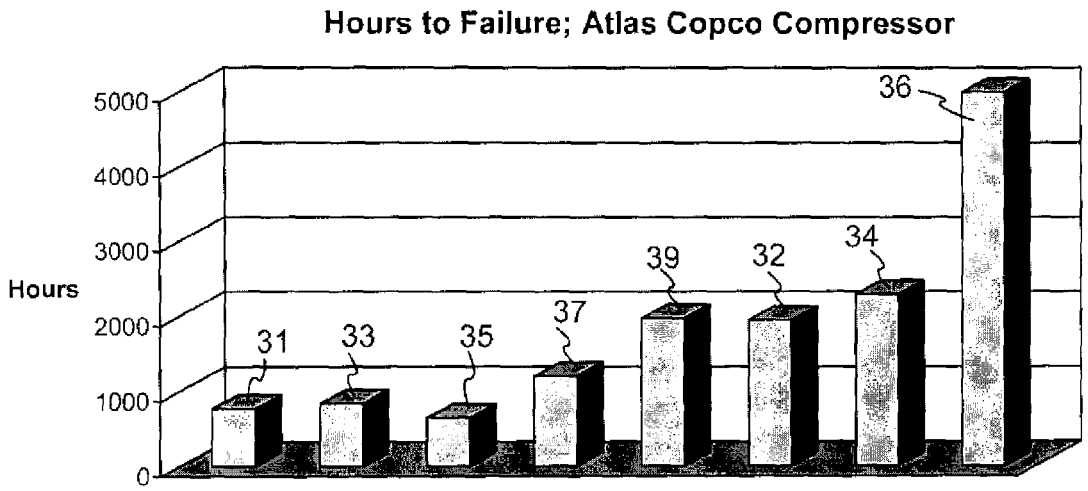
FIG. 3 is a bar graph comparing the favorable oxidation properties of a alkylated naphthalene formulation compared to other base stocks.

Table 3 shows the different lubricating oils and the number of hours it takes to break the oil in the oxidation test. FIG. 3 is a bar graph illustrating the different types of compressor oil and the time to break the oil in the Atlas Copco Compressor test. This is a test in which an Atlas-Copco Compressor is charged with a test oil and operated continuously at full pressure until the lubricant fails. Failure is determined when the lubricant in the compressor increases in viscosity by 30% over original value. Table 3 and FIG. 3 demonstrate a formulation with alkylated naphthalene as the primary base stock lasts significantly longer than the prior art formulations.

| Lube | Hours to break |
|---|---|
| Min oil | 770 |
| Min Oil | 839 |
| GpIII, PIB | 645 |
| 100% ester | 1200 |
| PAO, 30% GPIII, 20% AN | 1966 |
| PAO, 18% AN | 1943 |
| PAO, 20% AN | 2287 |
| All AN oil | 5,000 |

As shown in FIG. 3, typical mineral oils last about 700 hours in a screw compressor 31 and 33; Ester base stocks typically last about 1200 hours 37. Group II and PIB base stocks lasts less than 700 hours 35. PAO with 20 weight percent alkylated naphthalene lasts over 2200 hours 34. PAO with either 30 weight percent Group II and 20 weight percent alkylated naphthalene or 18 weight percent alkylated naphthalene lasts approximately 2000 hours 34 and 32 respectively. The lube made of mostly alkylated naphthalene base stock lasts an unexpected 5,000 hours 36. Table 4 shows the treat rate of the additives.

TABLE 4

| ISO VG 460 | EXPERIMENTAL | | | | | | | COMMERCIAL | |
|---|---|---|---|---|---|---|---|---|---|
| Kv 100° C. = 50-60 cSt | A | B | C | D | E | F | G | Conventional PAO-based lubricant | Conventional PAG-based lubricant |
| mHVI PAO 620 cSt | 45.7 | 51.7 | 19.7 | | | | | | |
| mHVI PAO 450 cSt | | | | 54.7 | | | | | |
| mHVI PAO 300 cSt | | | | | 60.7 | | | | |
| mHVI PAO 150 cSt | | | | | | 76.7 | | | |
| mHVI PAO 135 cSt | | | | | | | 78.7 | | |
| 40 cSt PAO | | | 70 | | | | | | |
| 4 cSt PAO | 41 | 38 | | 35 | 29 | 13 | 11 | | |
| Cobase stock & Additives | 13.3 | 10.3 | 10.3 | 13.3 | 13.3 | 10.3 | 10.3 | | |
| Worm Gear Ave Sump Temp ° F. | 152 | 157 | 159 | 169 | 168 | 158 | 158 | 175 | 150 |
| Worm Gear Ave Efficiency | 81.1 | 79.9 | 79.3 | 77.6 | 77.8 | 78.3 | 78.3 | 76.7 | 80.5 |
| ASTM D3427 75° C. Time to 0.2% Air (min) | 5.2 | 5.7 | 5.9 | 5.4 | 7.1 | 4.4 | 4.4 | 22.4 | 21 |
| ASTM D97 Pour Point ° C. | −42 | −42 | −39 | −48 | −39 | −42 | −42 | −42 | −33 |

TABLE 5

| Examples | T01 | T02 | T03 | T04 | T05 | Canditate 1 | Candidate 2 |
|---|---|---|---|---|---|---|---|
| Product Type | Gp II | Gp II | GP III | GP III (similar to GTL) | Gp IV | Extreme Modal | Extreme Modal |
| KV at 40 C., cst | 31.64 | 34.23 | 31.01 | 30.8 | 30.37 | 32.78 | 33.65 |
| KV at 100 C., cst | 5.405 | 5.716 | 5.759 | 6.062 | 5.698 | 6.867 | 6.874 |
| VI | 105 | 107 | 129 | 148 | 131 | 176 | 170 |

TABLE 5-continued

| Examples | T01 | T02 | T03 | T04 | T05 | Canditate 1 | Candidate 2 |
|---|---|---|---|---|---|---|---|
| D3427 Air Release at 50 C. | 2.22 | 2.92 | 1.76 | 1.82 | 1.5 | 1.13 | 1.12 |
| D3427 Air Release at 25 C. | 9.92 | 15.02 | 4.12 | 4.22 | 3.12 | 0.62 | 1.02 |
| D97 Pour pt, C. | −27 | −18 | −30 | −27 | −54 | <−54 | — |
| KV at −20° C. | 2750 | no flow at test temp | 1777 | 1518 | 1146 | 881 | 957.31 |
| D2983 Brookfield Viscosity | | | | | | | |
| Vis (mPA · s) −20 C. | 2490 | 743000 | 1240 | 1010 | 990 | 770 | 1120 |
| Vis (mPA · s) −20 F. | 22400 | 1000000 | | 3930 | 2360 | 1660 | 1950 |
| D5133 Scanning Brookfield | | | | | | | |
| Vis (cP) at −10° C. | 2800 | 1150 | 1539 | 1689 | 1169 | 281 | — |
| Vis (cP) at −20° C. | 3404 | 36468 | 2330 | 2660 | 1594 | 583 | — |
| Vis (cP) at −30° C. | 7945 | no flow | 5092 | 6393 | 3180 | 1644 | — |

As shown in Table 3 and 4, this new inventive base stock formulation that uses alkylated naphthalene as the primary base stock lasts 5,000 hours in the same Atlas-Copco screw compressor. This result were unexpected and novel, due to the utilization of a base stock which until now had been used only as a partial blending component, to give additive solubility to PAO blends. This discovery resulted in formulating an oil that will last more than two times longer than today's best performing synthetic lubricants.

In a preferred embodiment, the base stocks include at least one base stock of additional synthetic oils and most preferably include at least one base stock of API Group IV Polyalpha-olefins. Synthetic oil for purposes of this application shall include all oils that are not naturally occurring mineral oils. Naturally occurring mineral oils are often referred to as API Group I oils. These base stocks are then combined with additives to create a fully finished lubricant. Table 6 is an example of one embodiment of the invention in a fully formulated lubricant.

TABLE 6

| Component | Weight percentage in lubricant composition |
|---|---|
| Alkylated Naphthalene | 86.59 |
| PAO 100 | 12.00 |
| Rust Inhibitor | 0.20 |
| Rust Inhibitor | 0.10 |
| Metal Passivator | 0.06 |
| Defoamant | 0.20 |
| Anti Wear | 0.10 |
| Anti Wear | 0.25 |
| Anti Oxidant | 0.50 |

In one embodiment the lubricant comprises at least 55 weight percent of an alkylated naphthalene base stock with a viscosity of at least 2 cSt and less than 22 cSt kv100° C.; a PAO with a viscosity of at least 4 cSt and less than 250 cSt. The PAO base stock is at least 2 and less than 40 weight percent of the lubricant. At least 0.5 and less than 1.5 weight percent of the lubricant is an amine antioxidant. At least 0.5 and less than 1.5 weight percent of the lubricant is a defoamant and preferable a mixed silicone methacoloate defoamant. At least 0.1 and less than 0.4 weight percent of the lubricant is an alkylated rust inhibitor. The compressor oil having a viscosity of at least 4 cSt and less than 10 cSt kv100° C., less than 10 ppm metal content, less than 100 ppm sulfur content, and a VI greater than 70. In a more preferred embodiment the lubricant composition further comprises a phosphorus based antiwear, the phosphorus based antiwear comprising at least 0.5 and less than 1.0 weight percent of the lubricant and a metal activator, the metal passivator comprising at least 0.005 and less than 0.1 weight percent of the lubricant. Details of these additives and other potential additives are described in additional detail below.

We have discovered that increasing the alkylated naphthalene results in favorable oxidation properties. Table 7 shows a series of tests of increasing alkylated naphthalene in 5 weight percent increments improves oxidation performance. The test was stopped at 216 hours.

TABLE 7

| Break Time | % AN |
|---|---|
| 32.3 | 0 |
| 38.8 | 5 |
| 48.0 | 10 |
| 32.8 | 15 |
| 38.6 | 20 |
| 50.1 | 25 |
| 50.2 | 30 |
| 57.9 | 35 |
| 70.3 | 40 |
| 80.4 | 45 |
| 157.2 | 50 |
| 137.1 | 55 |
| 165.7 | 60 |
| 202.5 | 65 |
| 216 | 70 |

TABLE 7-continued

| Break Time | % AN |
|---|---|
| 216 | 75 |
| 216 | 80 |
| 216 | 85 |
| 216 | 90 |
| 216 | 95 |
| 216 | 100 |

Figure 4:
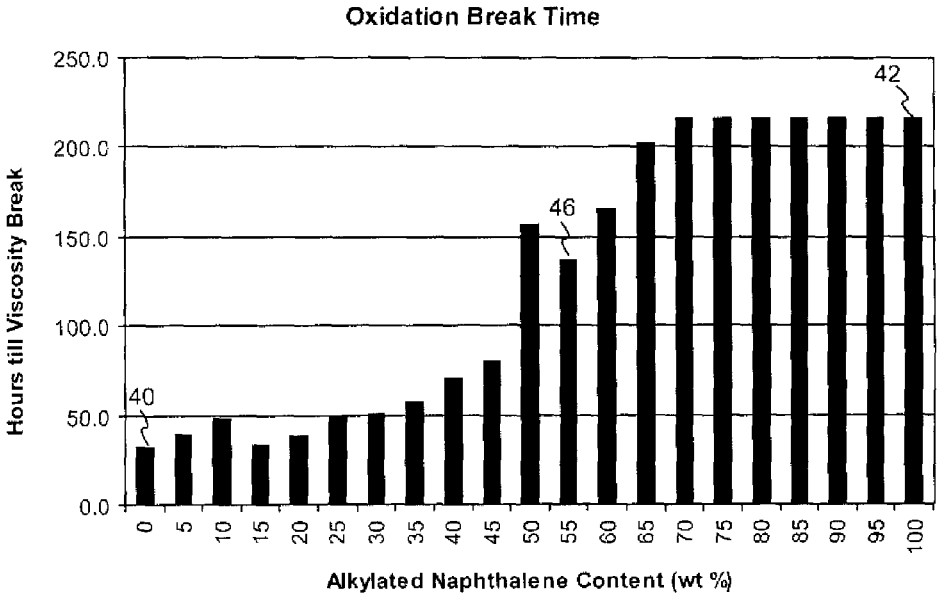
FIG. 4 is a bar graph illustrating that increasing alkylated naphthalene in 5 weight percent increments improves oxidation performance.

As shown in Table 7, formulations with greater than 55 weight percent provides significantly favorable oxidation properties. More preferably, the formulation should be greater than 60 weight percent alkylated naphthalene and most preferentially the formulation should be greater than 70 weight percent alkylated naphthalene. The oxidation properties in Table 6 and 7 are also shown in FIG. 4. A lubricant with only a PAO base stock has poor oxidation properties 40 when compared with a lubricant with only an alkylated naphthalene base stock 44. The preferred range is greater than 55 weight percent alkylated naphthalene with the balance PAO 46.

The PAO provides improved VI and hydrolytic stability. The lower VI of the alkylated naphthalene provides thicker films and the higher VI of the PAO provides favorable viscosity in extreme temperature swings. Accordingly, in one embodiment higher HVI PAO is added to get the desired VI, oxidation, air release and hydroelectric stability. The preferred VI range is at least 60, preferably at least 80 and more preferably at least 100. In one embodiment, a benefit of this formulation, is the relatively high VI with essentially no VI improver additives. In another preferred embodiment, essentially no PAG base stocks are used to avoid solubility issues. Regarding hydrolytic stability according to ASTM D 2619, the lubricant preferably has a water layer acidity of less than 10 mg KOH, more preferably a water layer acidity of less than 5 mg KOH, and most preferably a water layer acidity of less than 2.0 mg KOH.

Additives

In various embodiments, it will be understood that additives well known as functional fluid additives in the art, can also be incorporated in the functional fluid composition of the invention, in relatively small amounts, if desired; frequently, less than about 0.001% up to about 10-20% or more. In one embodiment, at least one oil additive is added from the group consisting of antioxidants, stabilizers, antiwear additives, dispersants, detergents, antifoam additives, viscosity index improvers, copper passivators, metal deactivators, rust inhibitors, corrosion inhibitors, pour point depressants, demulsifiers, anti-wear agents, extreme pressure additives and friction modifiers. The additives listed below are non-limiting examples and are not intended to limit the claims.

Dispersants should contain the alkenyl or alkyl group R has an Mn value of about 500 to about 5000 and an Mw/Mn ratio of about 1 to about 5. The preferred Mn intervals depend on the chemical nature of the agent improving filterability. Polyolefinic polymers suitable for the reaction with maleic anhydride or other acid materials or acid forming materials, include polymers containing a predominant quantity of $C_2$ to $C_5$ monoolefins, for example, ethylene, propylene, butylene, isobutylene and pentene. A highly suitable polyolefinic polymer is polyisobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerised isobutene having an Mn value of 500 to 1500. In preference, a polymerised isobutene having an Mn value of 850 to 1200 is used.

Amides suitable uses of amines include antiwear agents, extreme pressure additives, friction modifiers or Dispersants. The amides which are utilized in the compositions of the present invention may be amides of mono- or polycarboxylic acids or reactive derivatives thereof. The amides may be characterized by a hydrocarbyl group containing from about 6 to about 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to about 10 carbon atoms; Alk is an alkylene group containing up to about 10 carbon atoms.

The amide can be derived from a monocarboxylic acid, a hydrocarbyl group containing from 6 to about 30 or 38 carbon atoms and more often will be a hydrocarbyl group derived from a fatty acid containing from 12 to about 24 carbon atoms.

The amide is derived from a di- or tricarboxylic acid, will contain from 6 to about 90 or more carbon atoms depending on the type of polycarboxylic acid. For example, when the amide is derived from a dimer acid, will contain from about 18 to about 44 carbon atoms or more, and amides derived from trimer acids generally will contain an average of from about 44 to about 90 carbon atoms. Each is independently hydrogen or a hydrocarbyl, aminohydrocarbyl, hydroxyhydrocarbyl or a heterocyclic-substituted hydrocarbon group containing up to about 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The alkyl group can be an alkylene group containing from 1 to about 10 carbon atoms. Examples of such alkylene groups include, methylene, ethylene, propylene, etc. Also are hydrocarbylene groups, and in particular, alkylene group containing up to about 10 carbon atoms. Examples of such hydrocarbylene groups include, methylene, ethylene, propylene, etc. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methylpyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including hydrogen, or a hydrocarbyl, amino hydrocarbyl, hydroxyhydrocarbyl or heterocyclic-substituted hydrocarbyl group containing up to about 10 carbon atoms, Alk is an alkylene group containing up to about 10 carbon atoms, and is 2 to about 10. Preferably, Alk is ethylene or propylene. Usually, a will have an average value of from 2 to about 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200.degree. C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from:

Mannich bases that are condensation reaction products of a high molecular weight phenol, an alkylene polyamine and an aldehyde such as formaldehyde, Succinic-based dispersants that are reaction products of a olefin polymer and succinic acylating agent (acid, anhydride, ester or halide) further reacted with an organic hydroxy compound and/or an amine, High molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from about 0.1% up to 10-20% or more. Commonly used hydrocarbon backbone materials are olefin polymers and copolymers, i.e.—ethylene, propylene, butylene, isobutylene, styrene; there may or may not be further functional groups incorporated into the backbone of the polymer, whose molecular weight ranges from 300 tp to 5000. Polar materials such as amines, alcohols, amides or esters are attached to the backbone via a bridge.

Antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di (alkylphenyl) amines; and alkylated phenylenediamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthyl amine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenyl amine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as .alpha.-naphthylamine, phenyl-.alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthyl amine and nonylphenyl-.alpha.-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the invention at levels of about 0.05% to about 5%, more preferably about 0.25 to about 2% by weight based on the total weight of such compositions; with ratios of amine/phenolic to be from 1:10 to 10:1 of the mixtures preferred.

The oxidation inhibitors that are also useful in lube compositions of the invention are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfiirized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methyl-phenol[2,6-di(tert-butyl)-p-cresol, DBPC], and aromatic amines, e.g. N-phenyl-.alpha.-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-.alpha.-methylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl) amines such as di(2,4-diethylphenyl)amine and di(2-ethyl-4-nonylphenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-.alpha.-dimethylamino-p-cresol, 2,2'-methylenebis(4-alkyl-6-t-butylphenol)

compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methylphenyl)-propionylo-xy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-l)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-l)butyric acid]glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD) include polymethacrylates. Commonly used additives such as alkylaromatic polymers and polymethacrylates are useful for this purpose; typically the treat rates range from 0.001% to 1.0%.

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids (C8-C30), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid and C8-C24 mercapto-fatty acids.

Examples of Polybasic Carboxylic Acids: The alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749). Examples of the alkylamines which function as antirust additives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tri decyl amine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine. Examples of the aforementioned N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamin-e, palmitylpentylenediamine, stearylpentylenediamine, oleylpentylenediamine, beef tallow-pentylenediamine, hydrogenated beef tallow-pentylenediamine and soy bean pentylenediamine.

Demulsifying agents include alkoxylated phenols and phenol-formaldehyde resins and synthetic alkylaryl sulfonates such as metallic dinonylnaphthalene sulfonates. A demulsifing agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Functional fluids according to the invention possess a pour point of less than about −20 degree C., and exhibit compatibility with a wide range of anti-wear additive and extreme pressure additives. The formulations according to the invention also are devoid of fatigue failure that is normally expected by those of ordinary skill in the art when dealing with polar lubricant base stocks.

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100 degrees C. to 160 degrees C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present invention may also be one produced from alkoxylation of n-butanol with a mixture of alkylene oxides to form a random alkoxylated product.

Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Metal deactivating compounds/Corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably the acid is a C sub 4 to C sub 22 straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl)aminomethyl)triazole, 1-(or 4)-(di-n-decylaminomethyl)triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl) aminomethyl]triazole, 1-(or 4)-[di-(but-2'-enyl) aminomethyl]triazole, 1-(or 4)-[di-(eicos-2'-enyl) aminomethyl]triazole, 1-(or 4)-(di-cyclohexylaminomethyl) triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl) triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(di-butylaminopropyl-aminomethyl)triazole, 1-(or -4)-(1-methanomine)-N,N-bis(2-ethylhexyl)-methyl benzotriazole, N,N-bis-(1- or 4-triazolylmethyl) laurylamine, N,N-bis-(1- or 4-triazolylmethyl) oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybedenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl ((bisisopropyloxyphosphinothioyl)-thio) propionate, triphenyl thiophosphate (triphenyl phosphorothioate), tris(alkylphenyl) phosphorothioates and mixtures thereof (for example tris(isononylphenyl) phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-mercapto-1H-1,3-benzothiazole or ethoxycarbonyl 5-octyldithiocarbamate.

The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyldithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)-benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazo-le, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis (heptyldithio)-1,3,4-thiadiazole, 2,5-bis-(nonyldithio)-1,-3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyl-dithiocarbamyl-5-mercapto-1,3,4-thiadiazole, and triazole derivatives of 1-alkyl-2,4-triazoles such as 1-dioctylaminomethyl-2,4-triazole or concentrates and/or mixtures thereof.

Anti-wear agents/Extreme pressure agent/Friction Reducer: zinc alkyldithiophosphates, aryl phosphates and phosphites, sulfur-containing esters, phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C18-C28 primary alcohols having mostly C20 alcohols as determined by GLC (gas-liquid-chromatography)); and Alfol22+ alcohols (C18-C28 primary alcohols containing primarily C22 alcohols). Alfol alcohols are available from Continental Oil Company. Another example of a commercially available alcohol mixture is Adol 60 (about 75% by weight of a straight chain C22 primary alcohol, about 15% of a C20 primary alcohol and about 8% of C18 and C24 alcohols). The Adol alcohols are marketed by Ashland Chemical.

A variety of mixtures of monohydric fatty alcohols derived from naturally occurring triglycerides and ranging in chain length from C8 to C18 are available from Procter & Gamble Company. These mixtures contain various amounts of fatty alcohols containing 12, 14, 16, or 18 carbon atoms. For example, CO-1214 is a fatty alcohol mixture containing 0.5% of C10 alcohol, 66.0% of C12 alcohol, 26.0% of C14 alcohol and 6.5% of C16 alcohol.

Another group of commercially available mixtures include the "Neodol" products available from Shell Chemical Co. For example, Neodol 23 is a mixture of C12 and C13 alcohols; Neodol 25 is a mixture of C12 to C15 alcohols; and Neodol 45 is a mixture of C14 to C15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C11-C14, and the latter is derived from a C15-C18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C.sub.8-30) amine which includes n-octylamine, n-decylamine, n-dodecylamine, n-tetradecylamine, n-hexadecylamine, n-octadecylamine, oleyamine, etc. Also useful fatty amities include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula, R"(OR')xNH2, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C16), SURFAM P17B (tridecyloxypropylamine). The carbon chain lengths (i.e., C14, etc.) of the SURFAMS described above and used hereinafter are approximate and include the oxygen ether linkage.

An amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms and R 6 is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C11-C14 tertiary alkyl primary amines and "Primene JMT" which is a similar mixture of C18-C22 tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Lubricating compositions also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monocarboxylic acid which is optionally sulphurised in an amount which may be up to 35% by weight; and/or an ester of such an acid. At least one triazole or alkyl derivatives thereof, or short chain alkyl of up to 5 carbon atoms and is hydrogen, morphilino, alkyl, amino, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole; and The neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. The phosphites include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

Hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); the substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly C12 fatty alcohols; Alfol™ 22+ comprises C18-28 primary alcohols having mostly C22 alcohols, and so on. Various mixtures of monohydric fatty alcohols derived from naturally occurring triglycerides and ranging in chain length from C8 to C18 are available from Procter & Gamble Company. "Neodol™" alcohols are available from Shell Chemical Co., where, for instance, Neodol™ 25 is a mixture of C12 to C15 alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present invention will contain varying amounts of one or more of the above-identified metal dithiophosphates such as from about 0.01 to about 2% by weight, and more generally from about 0.01 to about 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50 C. to about 200 C. Thus, the preparation of O,O-di-n-hexyl phosphorodithioic acid involves the reaction of a mole of phosphorus pentasulfide with four moles of n-hexyl alcohol at about 100 C for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phosphonates can be used. Neutral acids of phosphorus acids are the triesters rather than an acid (HO—P) or a salt of an acid.

Any C4 to C8 alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An Extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S(N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200 C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (TRAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulphur-based extreme pressure additives such as dialkyl sulphides, dibenzyl sulphide, dialkyl polysulphides, dibenzyl disulphide, alkyl mercaptans, dibenzothiophene and 2,2'-dithiobis (benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulphur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks, AN, AB, ADPO, ADPS, ADPM, and/or a variety of mono-basic, di-basic, and tribasic esters in conjunction with low sulfur, low aromatic, low iodine number, low bromine number, high analine point, isoparafin.

EXAMPLES

We have compared the inventive novel formulations that provide enhanced oxidation properties against other common air compressor formulations. These formulations and their properties are shown in Table 5 below. The properties shown are RVBOT, TOST, Air release and compressor life. As show in Table 8 the alkylated naphthalene with a minor amount of PAO exhibited superior RVBOT, TOST, and compressor oil life and adequate air release when compared to the other formulations disclosed in Table 8.

TABLE 8

| | Formulation Chemistry: | | | | | |
|---|---|---|---|---|---|---|
| | Mineral oil | Gp III, PIB | all ester | PAO/20% ester | PAO/20% AN | Mostly AN |
| AN wt % | 0 | 0 | 0 | 0 | 20 | 86.6 |
| Base Oil Type | Grp 1 | Grp III | Ester | PAO/Ester | PAO/AN | AN PAO |
| Additives & wt % | | | | | | |
| Aminic Antioxidant | | 0.2 | 2.0 | 0.75 | 1.0 | 0.5 |
| Phenolic antioxidant | 0.25 | 0.6 | | | 0.75 | |
| Ashless acid alkenyl rust inhibitor | 0.05 | | 0.1 | 0.3 | 0.2 | 0.3 |
| Phosphorous based antiwear | 0.05 | | 0.1 | 0.3 | 0.2 | 0.35 |
| Dithiocarbamate antiwear | | 0.5 | | | | |
| Silicon based antifoam | 0.01 | | 0.01 | 0.3 | 0.2 | 0.2 |

TABLE 8-continued

| | Formulation Chemistry: | | | | | |
|---|---|---|---|---|---|---|
| | Mineral oil | Gp III, PIB | all ester | PAO/20% ester | PAO/20% AN | Mostly AN |
| Dimercapaptothiadiazole metal passivator | | | | 0.06 | | 0.06 |
| Benzotriazole metal passivator | 0.03 | | | | 0.03 | |
| Additive package w/AW, AO, dispersant | 0.5 | | | | | |
| Olefin copolymer | | 1.5 | | | | |
| RPVOT, mins | 415 | 1940 | 1130 | 1240 | 1365 | 1848 |
| TOST, hrs | 2938 | 10,000+ | <400 | 928 | 10,000+ | 10,000+ |
| Air Release, mins to 0.2% air | 8.4 | 2.2 | 2 | 2.1 | 2.5 | 7.7 |
| Compressor Oil life, hours | 654 | 645 | 1,200 | 1,313 | 2,148 | 5,000+ |

What is claimed is:

1. A lubricant, comprising a) an alkylated naphthalene base stock the alkylated naphthalene base stock is greater than or equal to 50 weight percent of the lubricant;

b) a PAO base stock with a viscosity of about 100 cSt kv100° C., the PAO base stock is at least 2 and less than or equal to 48.59 weight percent of the lubricant;

c) about 0.5 weight percent of the lubricant is an amine antioxidant additive;

d) about 0.2 weight percent of the lubricant is a defoamant additive;

e) about 0.3 weight percent of the lubricant is an alkylated rust inhibitor additive;

f) about 0.35 weight percent of the lubricant is a phosphorus based antiwear additive;

g) about 0.06 weight percent of the lubricant is a metal passivator additive; and h) the lubricant having less than 10 ppm metals, less than 100 ppm sulfur, and a VI greater than 70, and yields an oxidation break time of the oil of at least 137.1 hours as measured by the oxidation test.

2. The lubricant of claim 1 wherein the lubricant is a compressor oil.

3. The lubricant of claim 1 comprising at least one additional base stock chosen from the group consisting of GTL lubricants, wax derived lubricants, Polyalpha-olefin, Brightstocks, Brightstocks with PIB, Group II base stocks and any combination thereof.

4. The method of claim 1 further comprising at least one additional additive, the additive chosen from the group consisting of antioxidant, defoamant, demulsifier, friction reducer, rust inhibitor, and any combination thereof.

5. The lubricant of claim 1 wherein the defoamant additive is silicone based.

6. The lubricant of claim 1 wherein the lubricant comprises essentially no PAG base stocks and essentially no VI improvers.

7. The lubricant of claim 1 wherein the PAO base stock is a metallocene catalyzed base stock.

8. A method of formulating a lubricant comprising a) obtaining an alkylated naphthalene base stock;

b) obtaining a PAO base stock with a viscosity of about 100 cSt kv100° C.;

c) obtaining an amine antioxidant additive, a defoamant additive, and an alkylated rust inhibitor; and d) blending the base stocks and additives to obtain a lubricant wherein the alkylated naphthalene base stock is greater than or equal to 50 weight percent of the lubricant, the PAO base stock is at least 2 and less than or equal to 48.59 weight percent of the lubricant, about 0.5 weight percent of the lubricant is an amine antioxidant additive; about 0.2 weight percent of the lubricant is a defoamant additive; about 0.3 weight percent of the lubricant is an alkylated rust inhibitor additive; about 0.35 weight percent of the lubricant is a phosphorus based antiwear additive; about 0.06 weight percent of the lubricant is a metal passivator additive, and the lubricant has less than 10 ppm metals, less than 100 ppm sulfur, and a VI greater than 70, and yields an oxidation break time of the oil of at least 137.1 hours as measured by the oxidation test.

* * * * *